US011300021B2

(12) United States Patent
Bemman et al.

(10) Patent No.: US 11,300,021 B2
(45) Date of Patent: Apr. 12, 2022

(54) EXHAUST COMPONENT WITH LOUVER BRIDGE FOR SUPPRESSING VEHICLE EXHAUST PIPE RESONANCES AND VEHICLE EXHAUST SYSTEM WITH EXHAUST COMPONENT

(71) Applicant: Eberspächer North America Inc., Novi, MI (US)

(72) Inventors: Ya-Juan J. Bemman, Holly, MI (US); Murtaza Mohammed Hussein Attar, Northville, MI (US); Patrick Benjamin Fleming, Royal Oak, MI (US)

(73) Assignee: PUREM NOVI, INC., Novi, MI (US)

( * ) Notice: Subject to any disclaimer, the term of this patent is extended or adjusted under 35 U.S.C. 154(b) by 263 days.

(21) Appl. No.: 16/683,710

(22) Filed: Nov. 14, 2019

(65) Prior Publication Data

US 2021/0148261 A1 May 20, 2021

(51) Int. Cl.

| | |
|---|---|
| ***F01N 1/08*** | (2006.01) |
| ***F01N 1/00*** | (2006.01) |
| ***F01N 1/02*** | (2006.01) |
| ***F01N 13/18*** | (2010.01) |

(52) U.S. Cl.

CPC ..... *F01N 1/02* (2013.01); *F01N 13/1872* (2013.01); *F01N 2470/04* (2013.01)

(58) Field of Classification Search

CPC ... F01N 1/02; F01N 1/00; F01N 1/026; F01N 1/08; F01N 13/1872; F01N 13/08; F01N 13/185; F01N 13/18; F01N 2470/04; F01N 2470/02

See application file for complete search history.

(56) References Cited

U.S. PATENT DOCUMENTS

| | | | | |
|---|---|---|---|---|
| 2,251,369 A * | 8/1941 | Moss | F01N 13/1838 181/250 |
| 2,251,880 A * | 8/1941 | Hollerith | F01N 1/02 181/249 |
| 2,297,046 A * | 9/1942 | Bourne | F01N 1/023 181/250 |
| 4,192,401 A | 3/1980 | Deaver et al. | |

(Continued)

FOREIGN PATENT DOCUMENTS

| | | |
|---|---|---|
| EP | 2 336 518 A2 | 6/2011 |
| EP | 3 073 076 A1 | 9/2016 |

(Continued)

*Primary Examiner* — Edgardo San Martin
(74) *Attorney, Agent, or Firm* — McGlew and Tuttle, P.C.

(57) ABSTRACT

An exhaust system component includes a pipe having a pipe wall with an inner surface defining an exhaust gas passage and with an outer surface and a louver bridge portion formed in the pipe wall. The louver bridge portion has bridge ends transitioning from adjacent pipe wall portions to a bridge raised portion with raised side edges detached from adjacent opening side edges of the pipe wall. Each bridge side edge is radially outward of the adjacent opening side edge of the pipe wall to define a louver opening at each of two opposite sides of the louver bridge portion. Fluid communication through the two louvered openings, between the exhaust gas passage and an exterior of the component, attenuates resonant frequencies generated during operation of an exhaust system to which the exhaust system component is connected.

20 Claims, 12 Drawing Sheets

(56) References Cited

U.S. PATENT DOCUMENTS

| | | | | |
|---|---|---|---|---|
| 4,371,053 | A * | 2/1983 | Jones | F01N 1/02 181/249 |
| 5,350,888 | A * | 9/1994 | Sager, Jr. | F01N 1/006 181/247 |
| 6,341,664 | B1 | 1/2002 | Gerber | |
| 7,444,806 | B2 * | 11/2008 | Werber | F01N 1/24 60/322 |
| 8,528,692 | B2 * | 9/2013 | Teshima | F02M 35/1238 181/229 |
| 8,925,308 | B2 * | 1/2015 | Hildebrand | F01N 13/08 60/322 |
| 9,970,340 | B2 | 5/2018 | Abram et al. | |
| 10,900,396 | B2 * | 1/2021 | Ayesh | F01N 1/006 |
| 2006/0011409 | A1 * | 1/2006 | Mabuchi | F01N 1/026 181/232 |
| 2021/0285349 | A1 * | 9/2021 | Ostromecki | F01N 13/08 |

FOREIGN PATENT DOCUMENTS

| | | | |
|---|---|---|---|
| JP | S53 48905 | U | 4/1978 |
| JP | 2008240586 | A * | 10/2008 |

* cited by examiner

EXHAUST COMPONENT WITH LOUVER BRIDGE FOR SUPPRESSING VEHICLE EXHAUST PIPE RESONANCES AND VEHICLE EXHAUST SYSTEM WITH EXHAUST COMPONENT

TECHNICAL FIELD

This disclosure relates to an exhaust system component with features for suppressing vehicle exhaust pipe resonances and further relates to a vehicle exhaust system with such as an exhaust system component for resonance attenuation and damping to reduce noise.

TECHNICAL BACKGROUND

Vehicle exhaust systems direct exhaust gases generated by an internal combustion engine to the external environment. These systems are comprised of various components such as pipes, mufflers, catalytic converters, particle filters and other exhaust system components. All such vehicle exhaust systems have resonant frequencies, which are also referred to as natural frequencies of the exhaust system. The resonant frequencies are due to the physical structure or the layout of the exhaust systems. Resonant frequencies can be beneficial to a sound quality of some vehicle exhaust systems and yet can also be non-beneficial to the sound quality. The overall system and/or the components are capable of generating undesirable noise as a result of resonating frequencies.

Different approaches have been used to address undesirable noise as a result of resonating frequencies. Some ways to attenuate resonating frequencies include providing one or more muffler and or resonator. Locating the muffler and resonator where the resonance occurs can help attenuating the resonance frequency by splitting that frequency into two other frequencies or by shifting the frequencies. Packaging mufflers and resonators can be a challenge due to the size. A further disadvantage of adding additional components is that additional components add expense and increases weight. Adding components introduces new sources for noise generation.

There can be many design alternatives which can be used to suppress resonances such as, perforations on the pipes, resonators, mufflers, Helmholtz dampeners or resonators (Helmholtz), additional pipe length or shortened pipe lengths (if packaging permits it) etc. In some special cases, even Active Noise Cancellations (ANC) can be an alternative.

Incorporating a resonator unto the exhaust system relatively close or on the anti-node of the resonance frequency can suppress the resonant frequency, however, with the resonator, it can have packaging challenges.

Concentric or side branch Helmholtz can be one of the alternative structures and methods used. A Helmholtz could be used to shift a frequency to a higher or lower frequency, so the resonance frequency does not line up. Helmholtz works typically with an enclosed volume to be effective.

ANC systems utilize components such as microphones and speakers to generate noise that cancels out the undesirable noise. ANC can be integrated into the exhaust system to reduce the resonance frequencies' amplitude. The basic concept of ANC is to reduce unwanted sound by propagative sound waves at the same frequency by out of phase to cancel out or reduce the amplitude of response. This is somewhat similar in concept to the Helmholtz tuning but with speakers that can attenuate more frequencies.

A configuration with perforations on the pipes is disclosed in U.S. Pat. No. 9,970,340. A vehicle exhaust system includes a pipe having an outer surface and an inner surface that defines an internal exhaust component cavity configured to receive hot exhaust gases. The pipe extends along a center axis from a first pipe end to a second pipe end. At least one additional component is positioned upstream or downstream of the pipe. Plural bleed holes are formed in the pipe. One bleed hole is at a first anti-node position to reduce a resonance frequency. The bleed hole has an opening into the internal exhaust component cavity. A second bleed hole is formed in the additional component or in the pipe at a second anti-node position axially spaced from the first anti-node position along the center axis, to reduce resonant frequencies. A discontinuous member covers each bleed hole at the inner or outer surface. Perforations on pipe can be used to suppress resonance. However, such configurations present the potential of an acoustic error state, such as producing a whistling sound in the higher frequencies for some vehicle exhaust systems.

SUMMARY

It is an object of the invention to provide an exhaust system component that reduces resonance frequencies, particularly without creating whistling sounds.

It is an object of the invention to provide an exhaust system component that reduces 1st and 2nd firing orders, such as with four cylinder engines with sound issues at lower frequencies.

According to the invention an exhaust system component is provided with a louver bridge configuration that reduces resonance frequencies and also reduces 1st and 2nd firing orders collectively, without creating whistling sounds.

The exhaust system component comprises a pipe having a pipe wall with an inner surface defining an exhaust gas passage and with an outer surface and a louver bridge portion formed in the pipe wall. The louver bridge portion has bridge ends transitioning from adjacent pipe wall portions to a bridge raised portion, with raised side edges detached from adjacent opening side edges of the pipe wall. Each bridge side edge is radially outward of the adjacent opening side edge of the pipe wall to define a louver opening at each of two opposite sides of the louver bridge portion. This provides fluid communication through the two louvered openings, between the exhaust gas passage and an exterior of the component and dampens resonant frequencies generated during operation of an exhaust system to which the exhaust system component is connected.

The bridge raised portion covers an open region partially defined by the opening side edges at the inner surface of the louver bridge portion. The covering position of the bridge raised portion is radially outward of the open region. The open region defines a flow path from the exhaust gas passage to each louver opening at the two opposite sides of the louver bridge portion. The louver opening at each of two opposite sides of the louver bridge portion forms a portion of the flow path and directs a portion of gas flowing in the pipe out of the pipe through the respective louver opening to produce a gas divergence of flow that is parallel to the exhaust gas flow within the pipe and which does not cause radial impingement of hot exhaust gas.

Each louver opening has a height corresponding to a radial distance of an associated bridge side edge from the adjacent opening side edge of the pipe wall. Each louver opening has a length from one bridge end to another bridge end wherein the length of the louver opening is greater than the height of the louver opening. This may be provided based on the bridge raised portion extending along an bridge arc over the open region. The open region has an opening area preferably greater than about 50 $mm^2$, and advantageously between about 50 $mm^2$ and 100 $mm^2$, such as about 87.65 $mm^2$. This open region may vary depending upon the size of the pipe but has an area that is preferably larger than a corresponding circular opening having an 8 mm diameter (i.e., larger than 50.27 $mm^2$). The adjacent pipe wall portions extend mostly along an arc having a diameter smaller than the diameter of a bridge diameter circle that defines the bridge arc. With the open region having an area of about 87.65 $mm^2$, the two louver openings have an opening area of about 31.35 $mm^2$. The louver openings are preferably in proportion with the size of the open region and preferably at about the same ration as provided by the above discussed example.

The exhaust system component may advantageously further comprise at least an additional louver bridge portion that is essentially the same as the first mentioned louver bridge portion to provide a plurality of louver bridge portions. The plurality of louver bridge portions may be disposed circumferentially spaced from each other. The plurality of louver bridge portions may alternatively be disposed longitudinally spaced from each other.

The configuration of the plural bridge portions may be such that the plurality of louver bridge portions are disposed in multiple rows of bridge portions. The plurality of louver bridge portions may alternatively be disposed in staggered rows of bridge portions.

The pipe wall and the louver bridge portion is advantageously formed of a single sheet metal piece. This may be formed by creating a tubular pipe portion as is generally known and making two shearing cuts. The strip may be bent out of the metal piece to form the raised portion of each louver bridge.

According to a further aspect of the invention, an exhaust system is provided comprising an exhaust treatment component and an exhaust pipe connected to the exhaust treatment component. The exhaust pipe comprises an exhaust pipe component as discussed above.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF PREFERRED EMBODIMENTS

Figure 1:
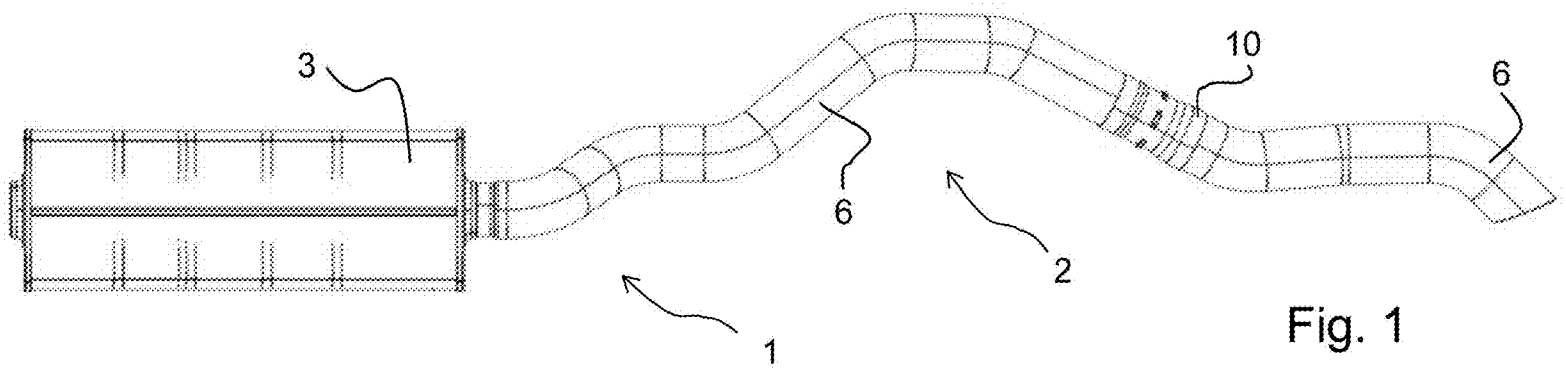
FIG. 1 is a side view of a portion of an exhaust system showing features of an exhaust system layout according to the invention.

Referring to the drawings in particular, FIG. 1 shows a portion of an exhaust system generally designated 1 with an exhaust pipe portion generally designated 2 and with an exhaust treatment component 3. The exhaust treatment component 3 may be for sound attenuation and/or for affecting the content of the exhaust gas. For example, the exhaust treatment component 3 is a muffler in the embodiment that is shown. However, the exhaust treatment component 3 could be some other sound attenuating feature and could also be one or more further components including a sound attenuating feature in combination with a feature to filter/remove soot particles and or gas components from the exhaust gas stream. The sound attenuating features may include one or more mufflers, resonators, valves and even active noise control (ANC) features. The exhaust system features for treating the content of the gas may include catalytic converters, filter arrangements and other features for reducing soot and $NO_X$ or other constituents of exhaust gas.

Figure 2:
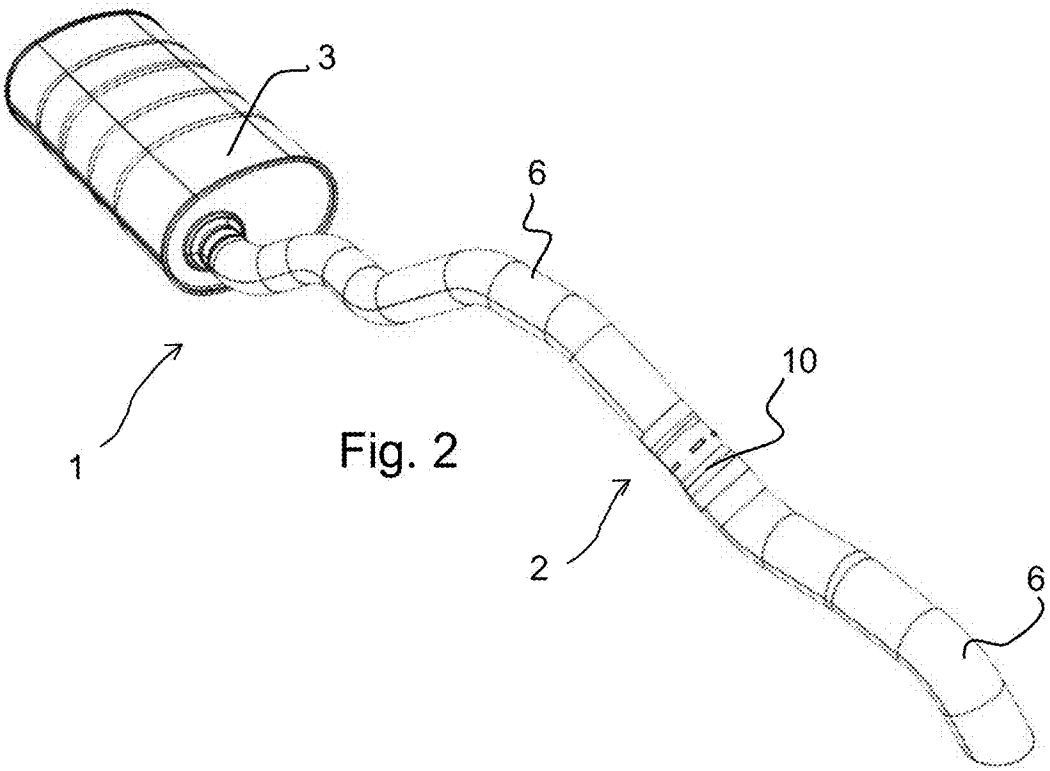
FIG. 2 is a perspective view of the exhaust system layout shown in FIG. 1.

Downstream of the exhaust gas treatment component 3, the exhaust pipe portion 2 comprises a plurality of pipe section components 6 and an exhaust system component to attenuate resonant frequencies that is generally designated 10. The exhaust pipe portion 2 may be formed by a single pipe section that includes the exhaust system component 10 as an integral portion of the single pipe section. Instead of numerous pipe section components 6, a single pipe section component 6 may be provided between the exhaust gas treatment device 3 and the exhaust system component 10. In this case a downstream further pipe section component 6 or plural pipe section components 6 follow the exhaust system component 10 in the direction of exhaust gas flow (from left to right in FIG. 1) to a pipe end. As particularly shown in FIG. 2, the use of the numerous pipe section components 6 allows for the various components to be combined to provide the desired exhaust gas path and desired shape of the path of the exhaust pipe portion 2. This avoids costs as to providing longer length shaped pipe sections of specialized shapes.

Figure 3:
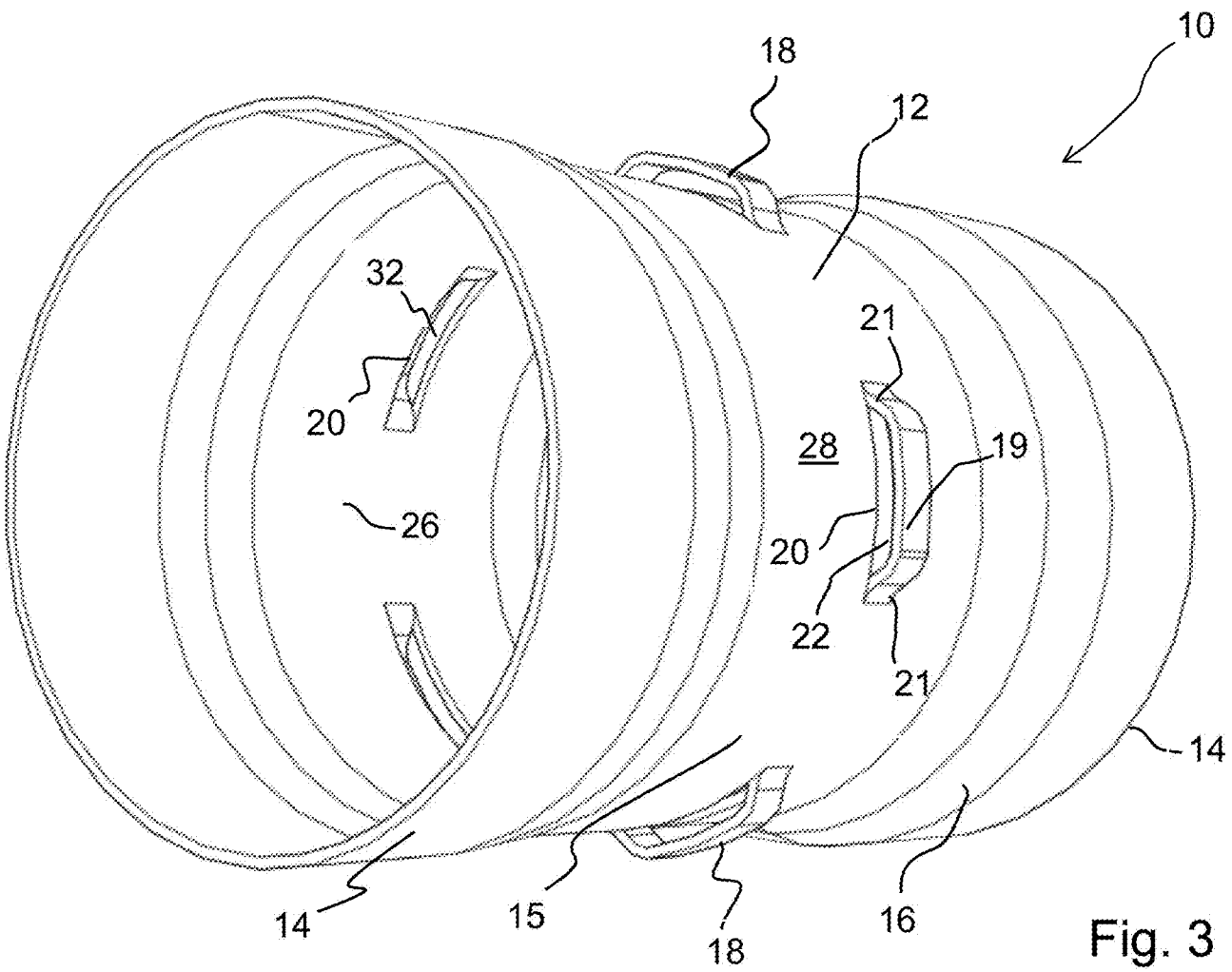
FIG. 3 is a lower perspective view of the exhaust system component showing louver bridge portions at a pipe wall of the exhaust system component.
Figure 4:
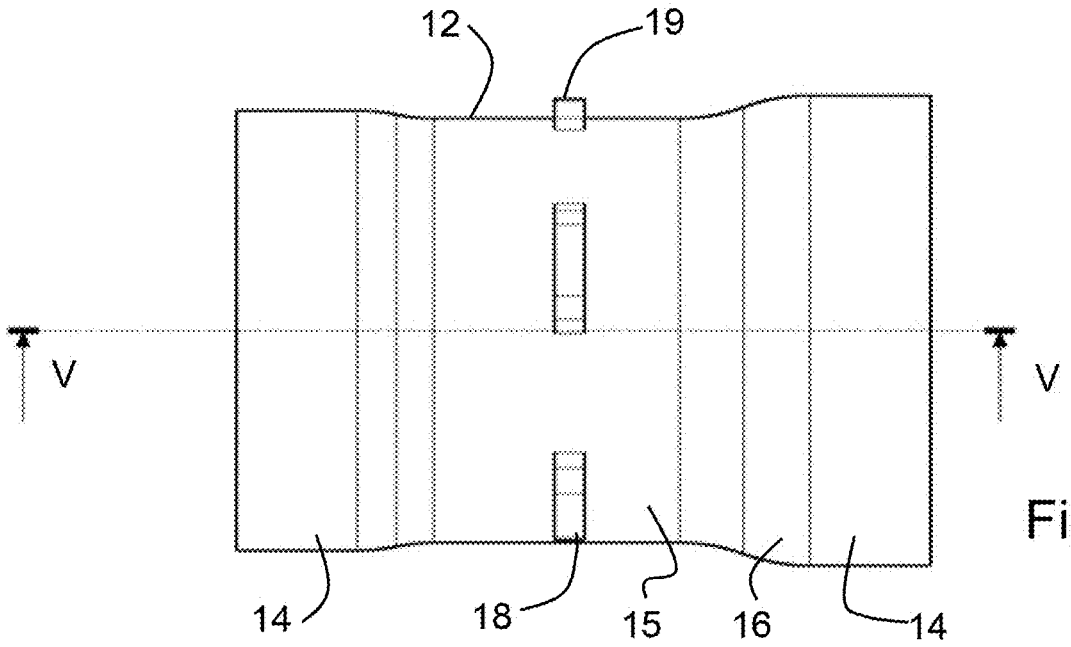
FIG. 4 is a side view of the exhaust system component of FIG. 3.
Figure 5:
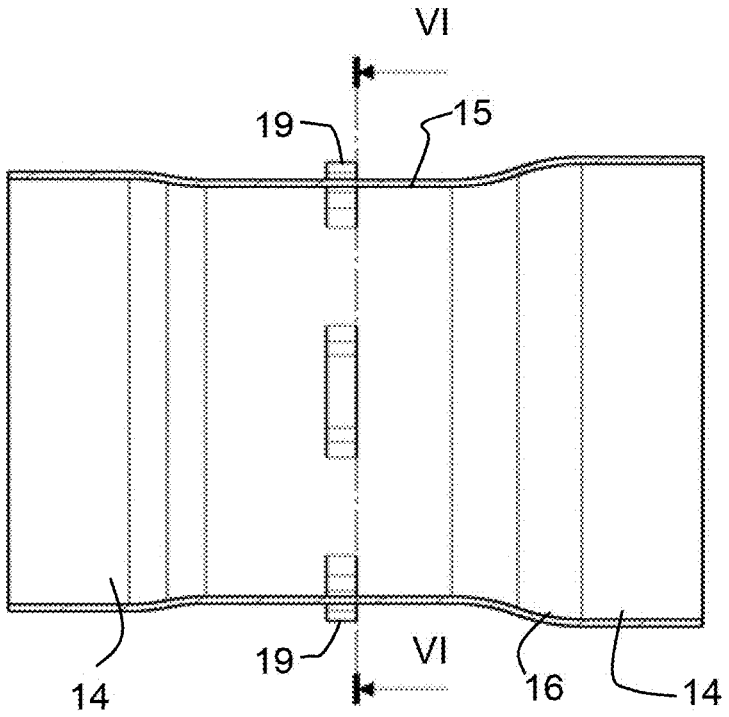
FIG. 5 is a side sectional view of the exhaust system component of FIG. 3, taken in the direction of line V-V of FIG. 4.

FIG. 3 shows the exhaust system component 10 in the form of a pipe component having a pipe wall 12. The pipe wall 12 has a central region 15 with angled portions 16 leading to an end flange 14 at each end. The end flanges 14 are somewhat radially wider as compared to the dimension of the central region 15.

In the configuration shown in the Figures, each of the regions 14, 15, 16 has a generally circular shape. However, these regions may be provided with a modified shape such as an oval configuration or even a rectangular configuration. The widening of the pipe wall 12 from central region 15, via angled regions 16 to flange ends 14 allows for each flange end 14 to be easily connected with upstream and downstream pipe section components 6 of a slightly smaller diameter (dimension).

The pipe wall 12 has an outer surface 28 and has an inner surface 26, which inner surface 26 defines an exhaust gas passage for an exhaust gas flow 60. This exhaust gas passage of component 10 cooperates with passage portions formed by the other components of the exhaust system, in particular in combination with the pipe sections 6 and the gas treatment component 3 as well as further upstream pipe sections and further gas components to provide a system exhaust gas flow path. The pipe wall 12 further includes louver bridge portions (louver bridges) 18 which are formed integrally with the pipe wall 12.

Each of the louver bridges 18 includes a central bridge raised portion 19 connected to the remainder of the pipe wall 12 via bridge ends 21. The bridge ends 21 provide a shape transition from the adjacent pipe wall 12 to the bridge raised portion 19 with the side edges 22 of the louver bridge portion 18 detached from adjacent opening side edges 20 of the pipe wall 12. The shape transition from the adjacent pipe wall 12 to the bridge raised portion 19 includes a first concave portion (curved oppositely to the curve the remainder of the pipe wall 12) with a radius of 1.5 mm in the example followed by a second convex portion (curved in the same direction as the curve the remainder of the pipe wall 12) that has a radius of 4 mm in the embodiment shown in the Figures. The bridge raised portion 19 itself follows a curve of a bridge circle having an internal diameter of 76.6 mm. In the embodiment shown, the central region 15 of the pipe wall 12 also follows the path of a circle with an outer diameter which is smaller than the bridge circle diameter. The remainder of the pipe wall 12 in the central region 15 has an internal diameter of 70 mm.

Figure 6:
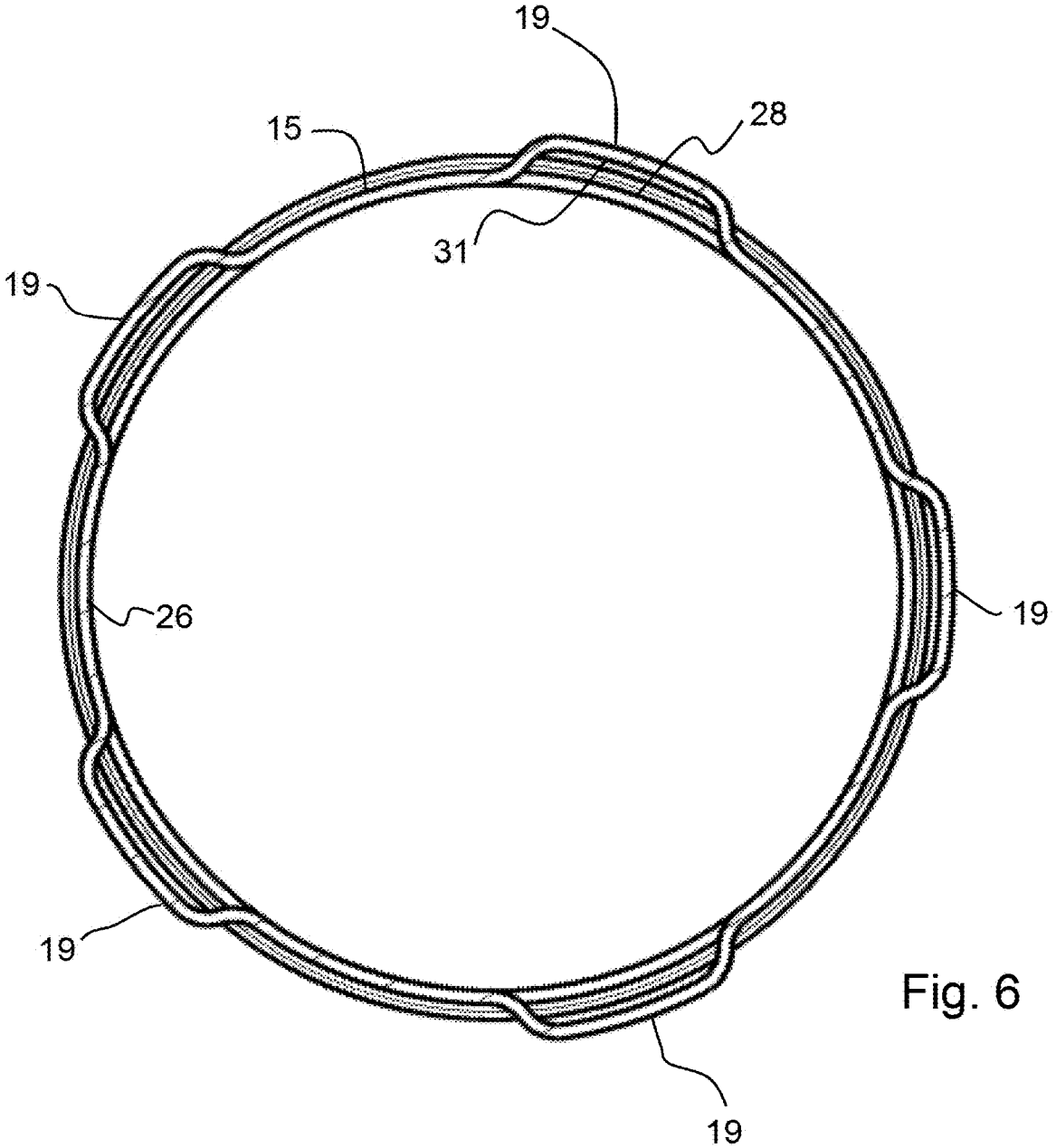
FIG. 6 is an end sectional view of the exhaust system component of FIG. 3, taken in the direction of line VI-VI of FIG. 5.

FIG. 6 shows a distance between an outer surface 28 of the pipe wall 12 near opening side edge 20 and the inner surface 31 of the louver bridge portion 18. The formation of the louver bridge portions 18 leaves an open region 32 partially defined by opening side edges 20 at the inner surface 36 of the louver bridge portion 18 (see FIG. 3). With this configuration, the inner surface 31 of the raised portion 19 is spaced from the adjacent surface regions 28 of the outer surface of the pipe wall 12 (see FIG. 6) to form side openings 30, at each side of the raised portion 19. As indicated in FIG. 3, a louver bridge edge 22 (an edge of the bridge inner surface 31) in cooperation with one of the opening side edges 20 defines one louver opening 30 at one side of the louver bridge 18 and another louver bridge edge 22 (at another edge of the bridge inner surface 31) in cooperation with another of the opening side edges 20 defines another louver opening 30 at another side of the louver bridge 18. This configuration of the louver bridge 18, and the formed open region 32, provides louver openings 30 at each side of each of the louver bridges 18. With louver openings 30 at opposite sides of each louver bridge portion 18, fluid communication is provided between the exhaust gas passage (the internal exhaust component cavity) of the interior of the pipe wall 12 and an exterior environment (ambient) of the component 10 to dampen resonant frequencies generated during operation of the exhaust gas system 1. In particular, pressure pulses within the exhaust gas passage are dampened based on the fluid communication provided by the flow path defined by the open region 32, the bridge inner surface 32 and the two louver openings 30 of each lover bridge 18.

Figure 7:
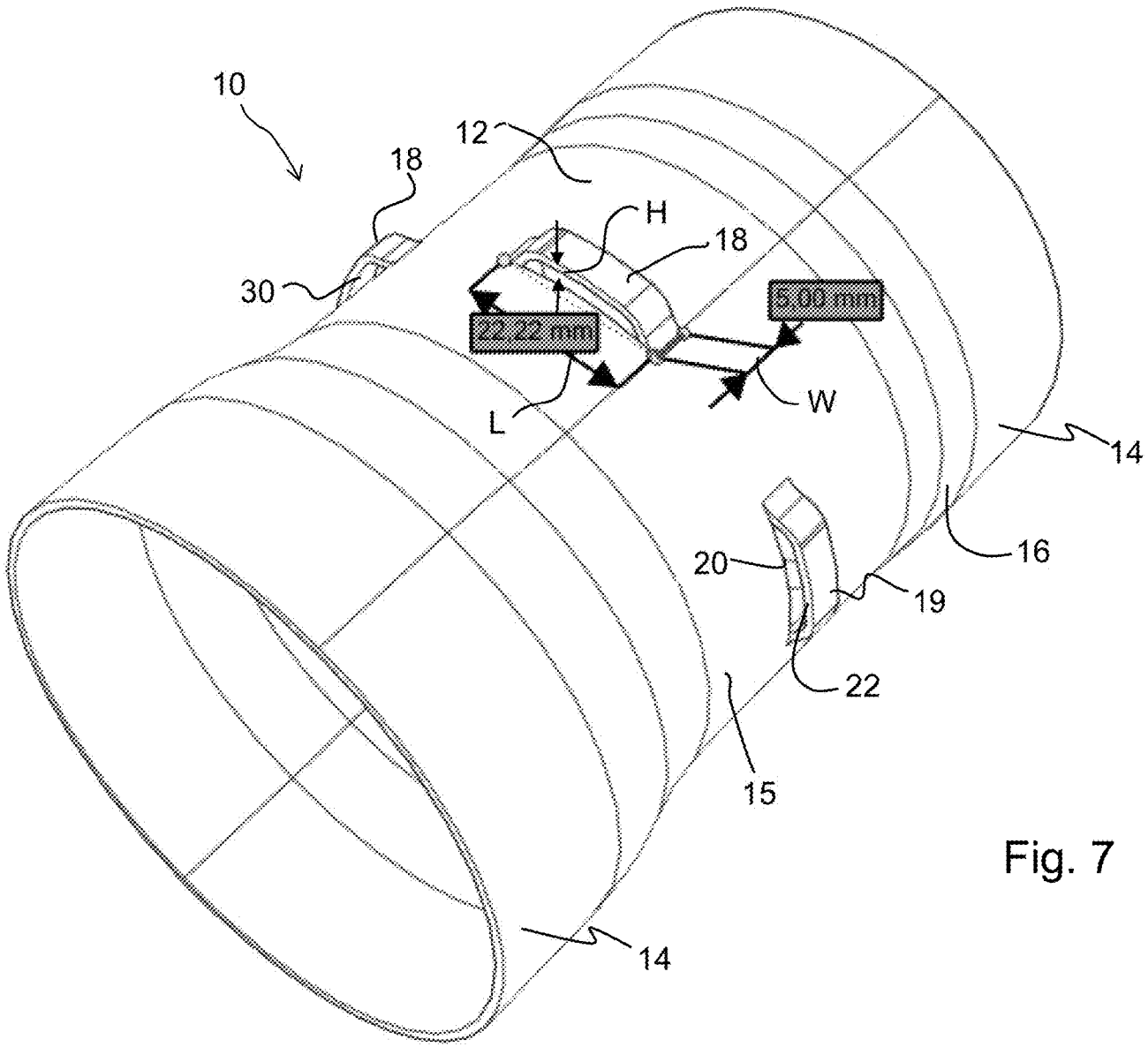
FIG. 7 is a top perspective view of the exhaust system component of FIG. 3, showing some dimensional aspects of an example of the louver bridge configuration.
Figure 8:
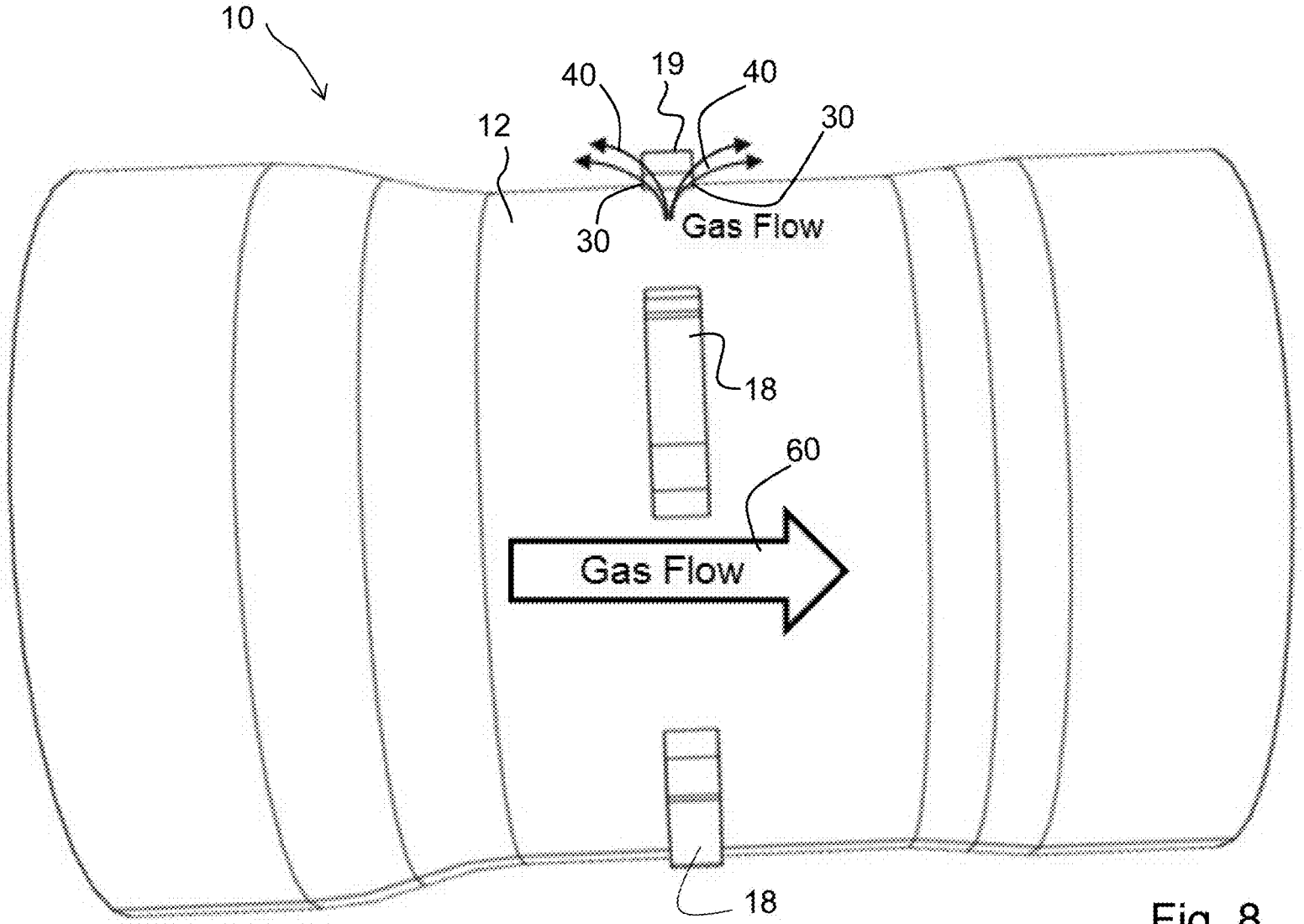
FIG. 8 is a partially schematic view indicating exhaust gas flow through the exhaust system component and showing gas flow out of each of the louver openings of one louver bridge configuration.

As indicated in FIG. 8, each louver bridge 18 provides two louver openings 30. As can be seen in FIG. 7, these openings 30 have a height H—the radial distance between the associated bridge side edge 22 and the adjacent opening side edge 20. This height H is essentially constant in the shown example as the central region 15 of the pipe wall 12 has a circular shape and in the example shown, the central, raised portion 19 of each louver bridge 18 extends essentially along a bridge arc corresponding to the bridge diameter circle mentioned above. The bridge circle of the louver bridges 18 and the circular shape of the central section 15 of the pipe wall 12 can be appreciated from FIG. 6. As shown in FIG. 6, the louver bridge ends 21 transition the shape of the passage of the exhaust system component 10 from the circular shape of the central region 15 of the pipe wall 12, to the bridge arc of the raised portion 19, which arc follows the bridge diameter circle. The bridge raised portion 19 with the side edges 22 detached from the adjacent opening side edges 20 of the pipe wall 12, provides the louver openings 30 with an essentially constant height between the transition regions provided by the louver bridge ends 21. The length L of the louver openings, between the louver bridge ends, in the shown example is 24 mm and the width W of the louver bridge 18 is 5 mm. The dimensions of the example are not critical but present advantageous dimension ratios providing excellent resonance attenuation and damping to reduce noise. The length L of the louver openings should be much greater than the height H. The width W of the louver bridge is preferably smaller than the length L. The height H, length L, and width W of the louver bridges 18, define the size of the open region 32 and the two louver bride openings 30, and define flow characteristics of the flow path from the interior of the component 10 to ambient.

The embodiment shown in the Figures provides a preferred construction in which a plurality of louver bridges 18 are provided spaced apart in a circumferential row with each louver bridge 18 following another in the circumferential direction. Five such louver bridges are shown that have a center of the raised portions 19 spaced apart by 72 degrees. This presents one aligned row of circumferentially distributed louver bridge portions 18. The plurality of louver bridge portions 18 may instead be disposed longitudinally spaced from each other, for example extending in an axial direction along the pipe wall 12. Instead of a single row of louver bridge elements 18, multiple rows of bridge portions 18 may be provided. Further, instead of providing an aligned row of bridges 18, a staggered row of bridges may be provided wherein the bridge portions 18 are spaced apart radially and also spaced apart axially. The exhaust system component 10 preferably has plural louver bridge elements 18 to best provide resonant frequency attenuation.

Figure 9:
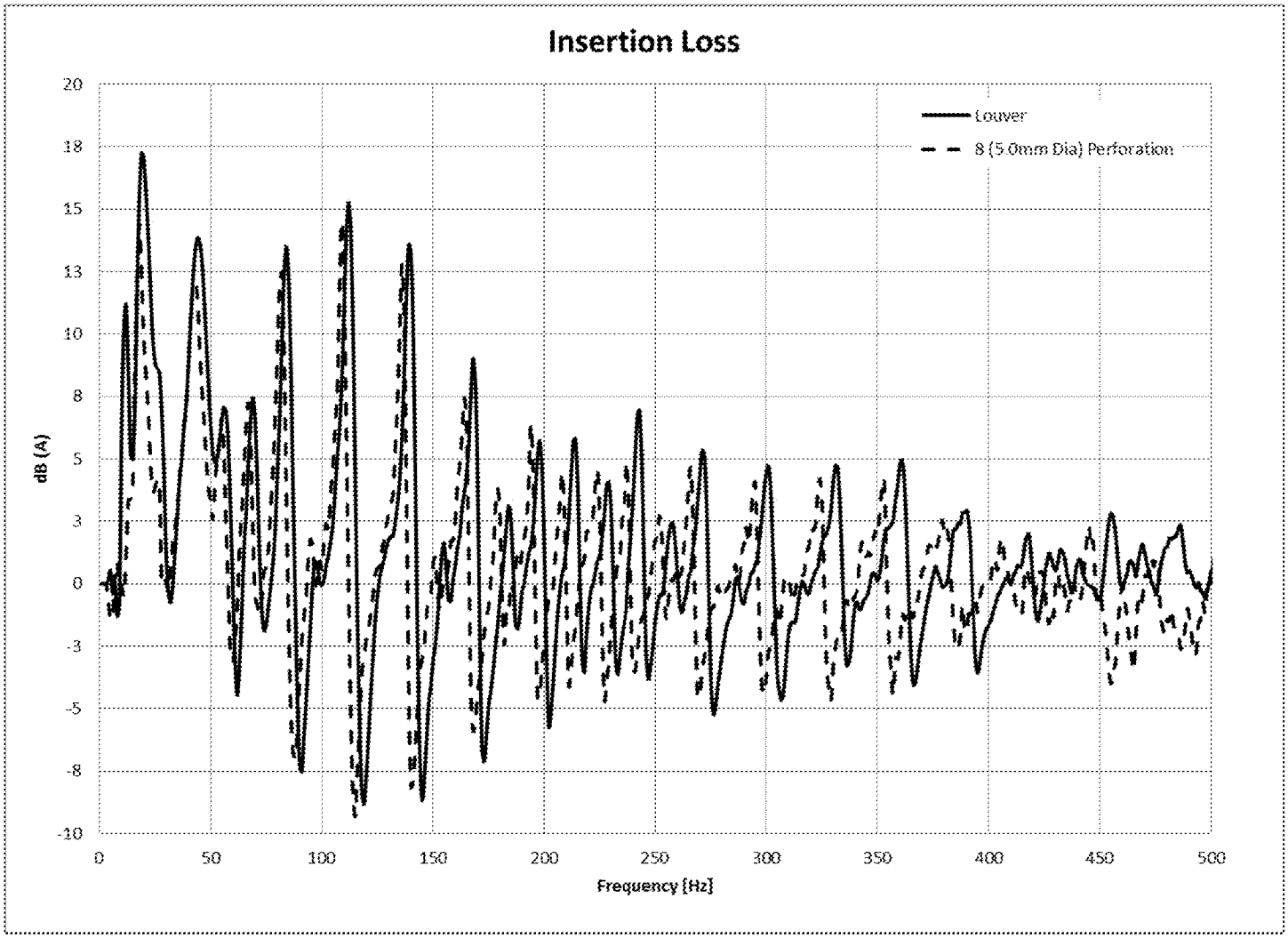
FIG. 9 is a graph showing measured insertion loss in decibels over a frequency range of 0 to 500 Hz.
Figure 10:
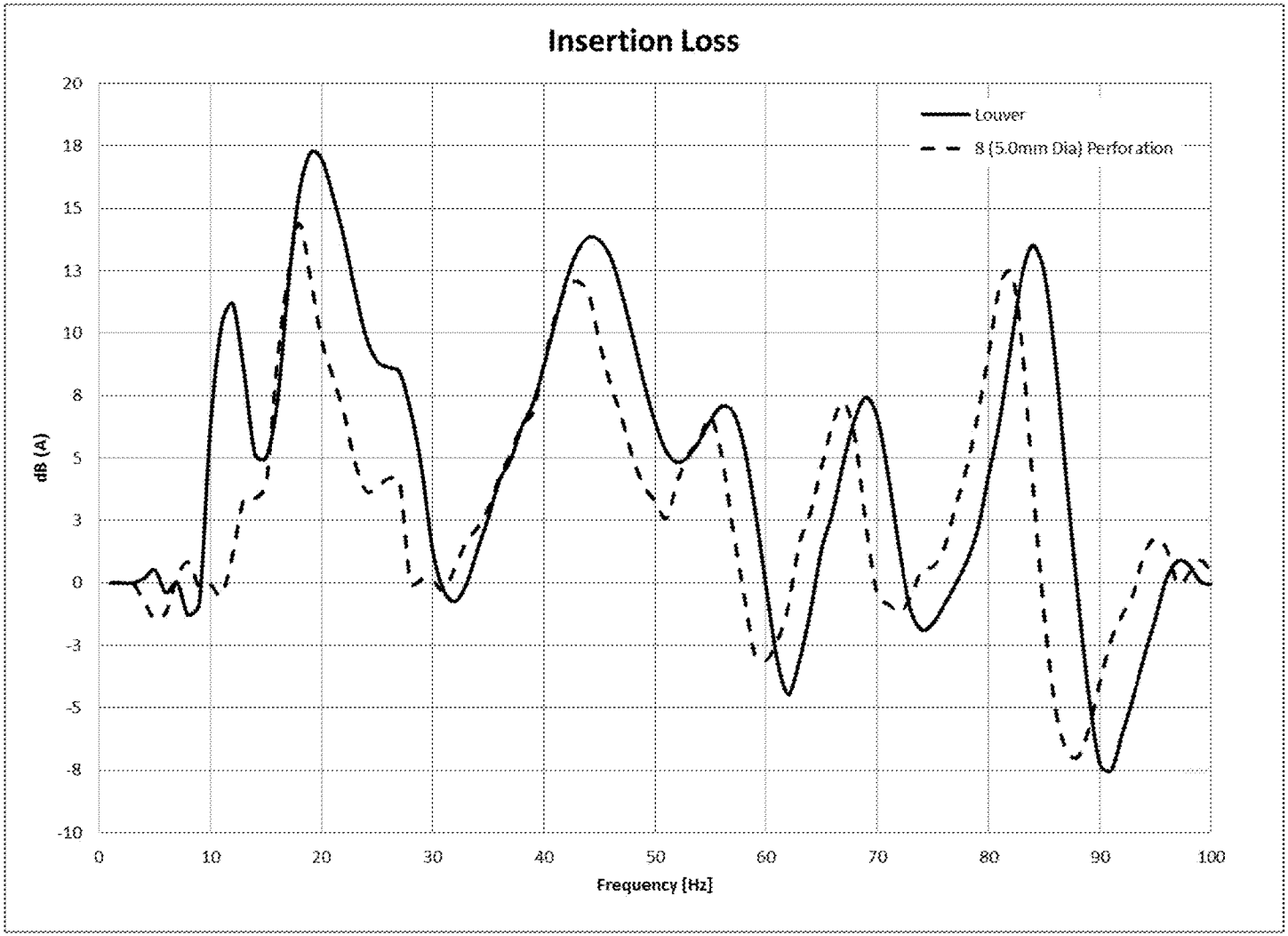
FIG. 10 is a graph showing the measured insertion loss in decibels of FIG. 8, over frequency range of 0 to 100 Hz.
Figure 11:
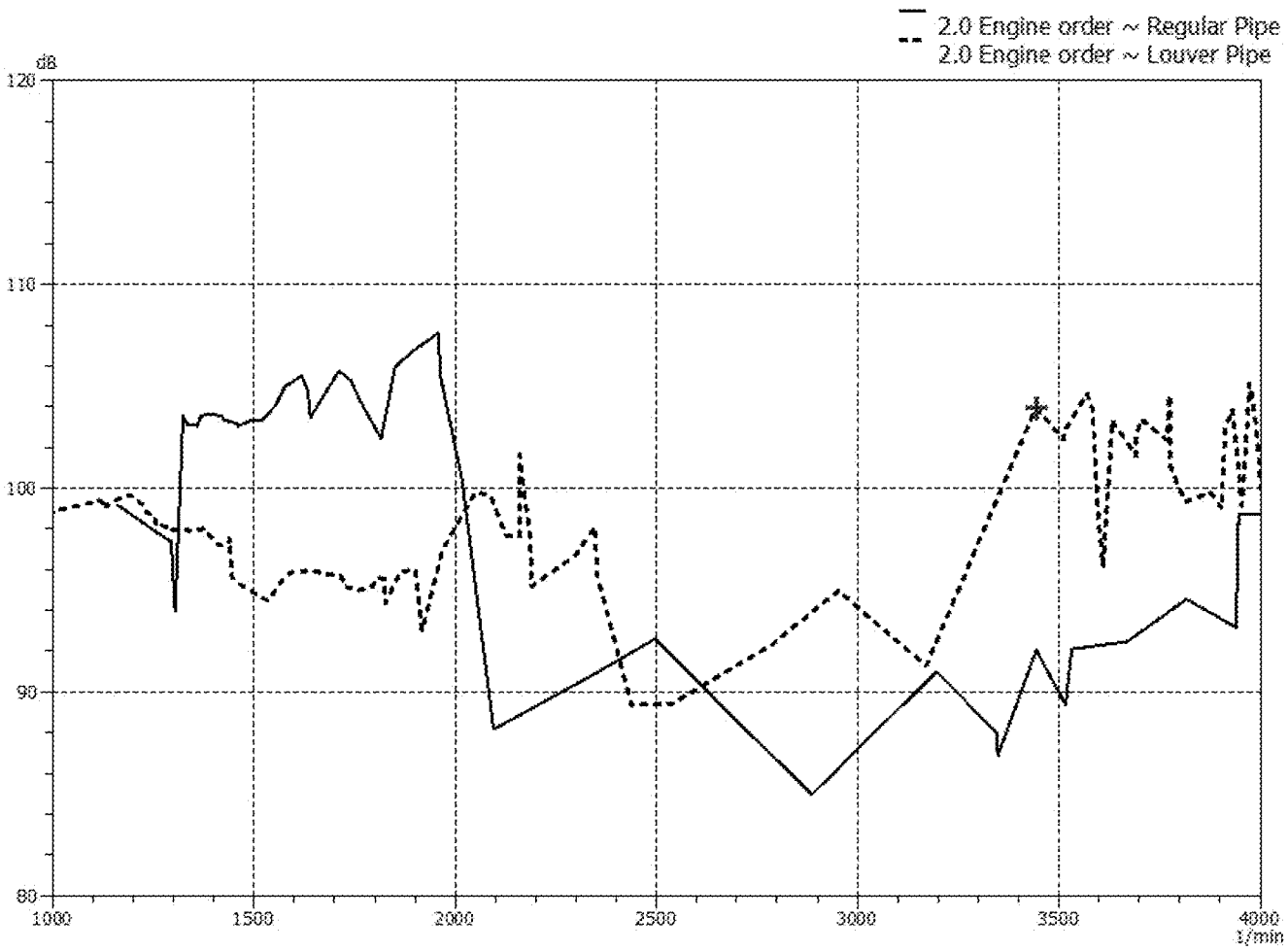
FIG. 11 is a graph showing second engine order sound in decibels for second order frequency of 1000 to 4000 per minute (the frequency of the revolutions per minute of the engine multiplied by a factor of 2) for a regular pipe (solid line) and for a pipe according to a first example of the system according to the invention (dashed line)
Figure 12:
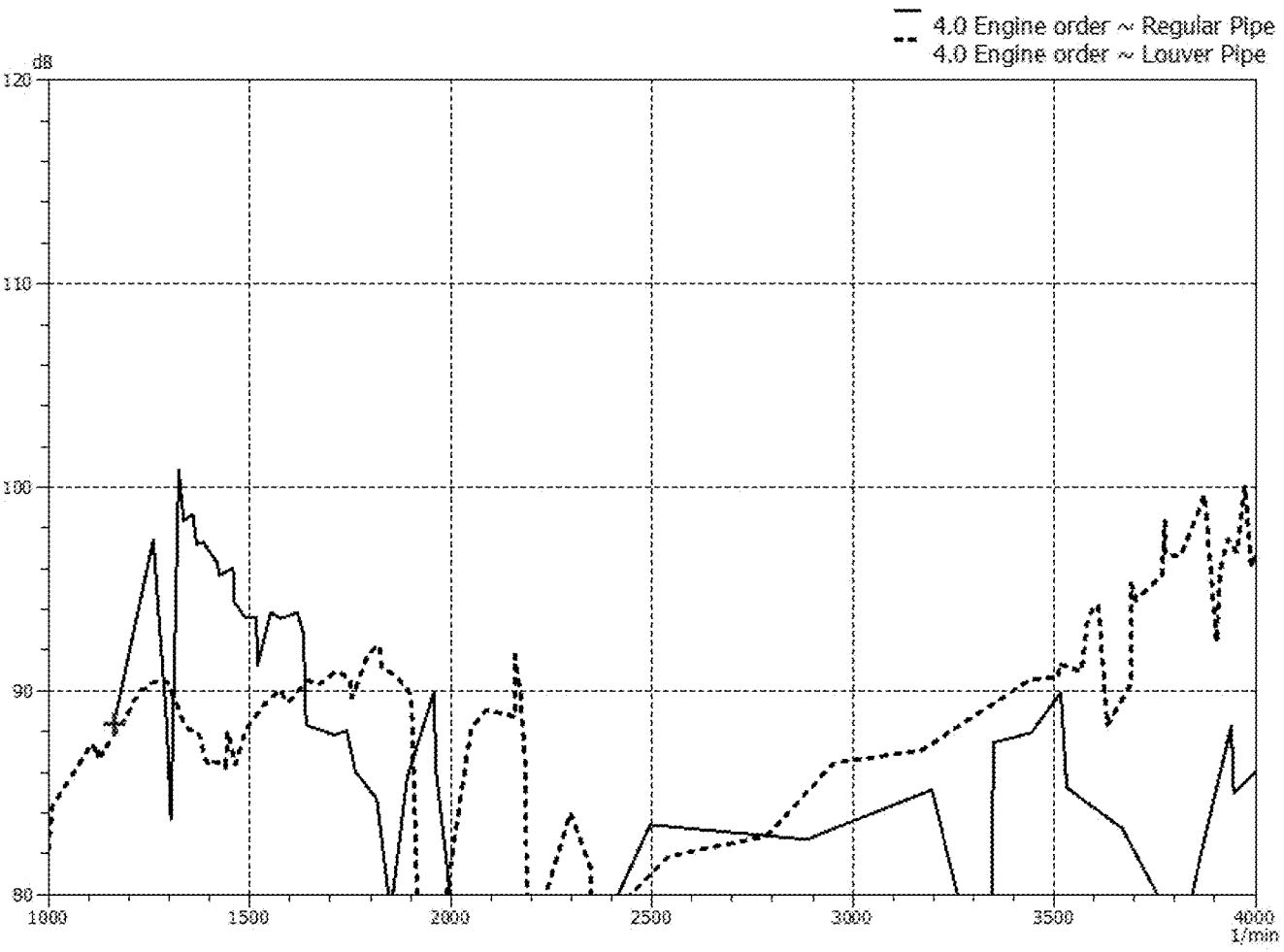
FIG. 12 is a graph showing fourth engine order sound in decibels over a fourth order frequency of 1000 to 4000 per minute for a regular pipe (solid line) and for the pipe according to the first example of the system according to the invention (dashed line)
Figure 13:
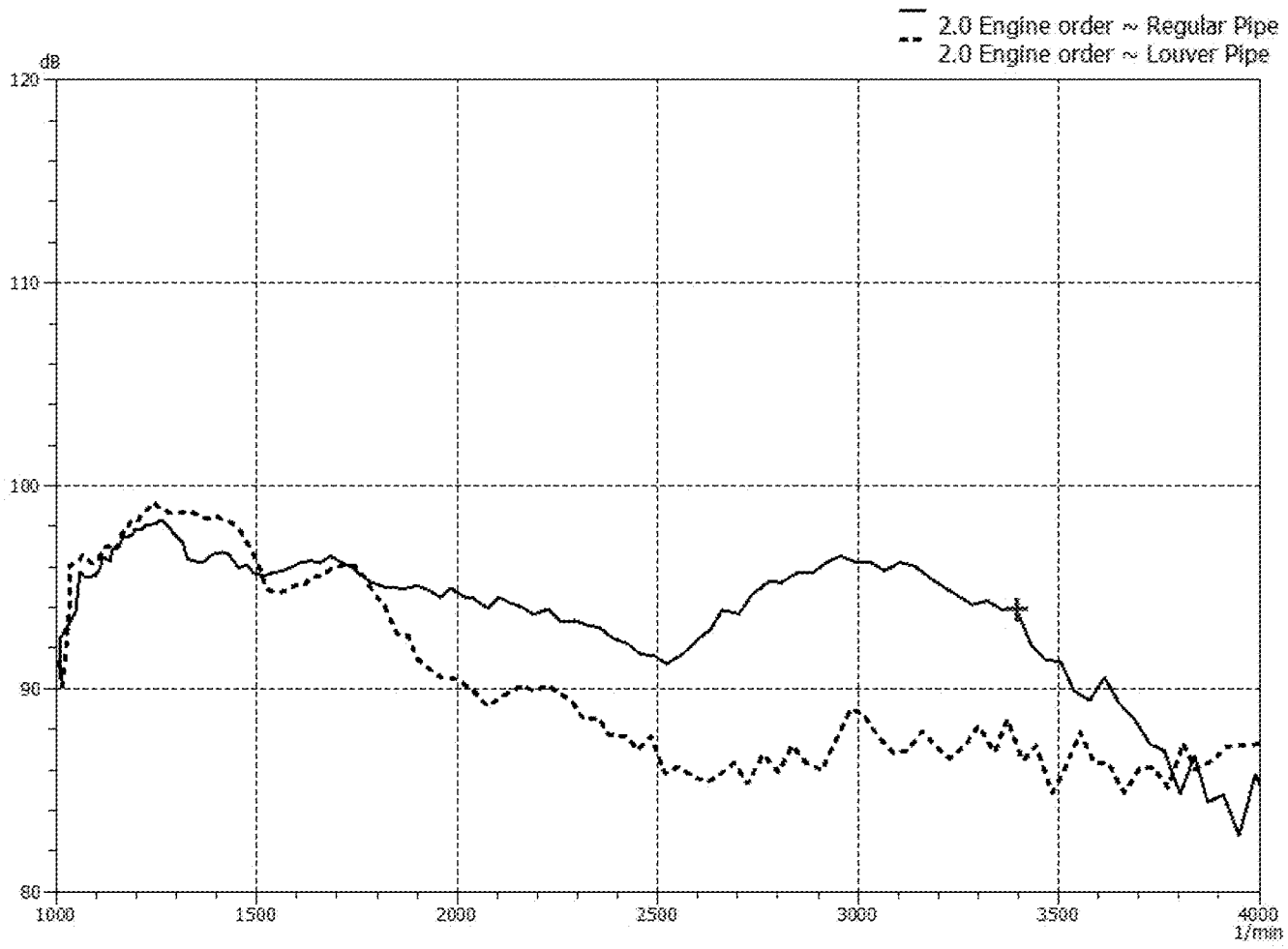
FIG. 13 is a graph showing second engine order sound in decibels over a second order frequency of 1000 to 4000 per minute for a regular pipe (solid line) and for a pipe according to a second example of the system according to the invention (dashed line)
Figure 14:
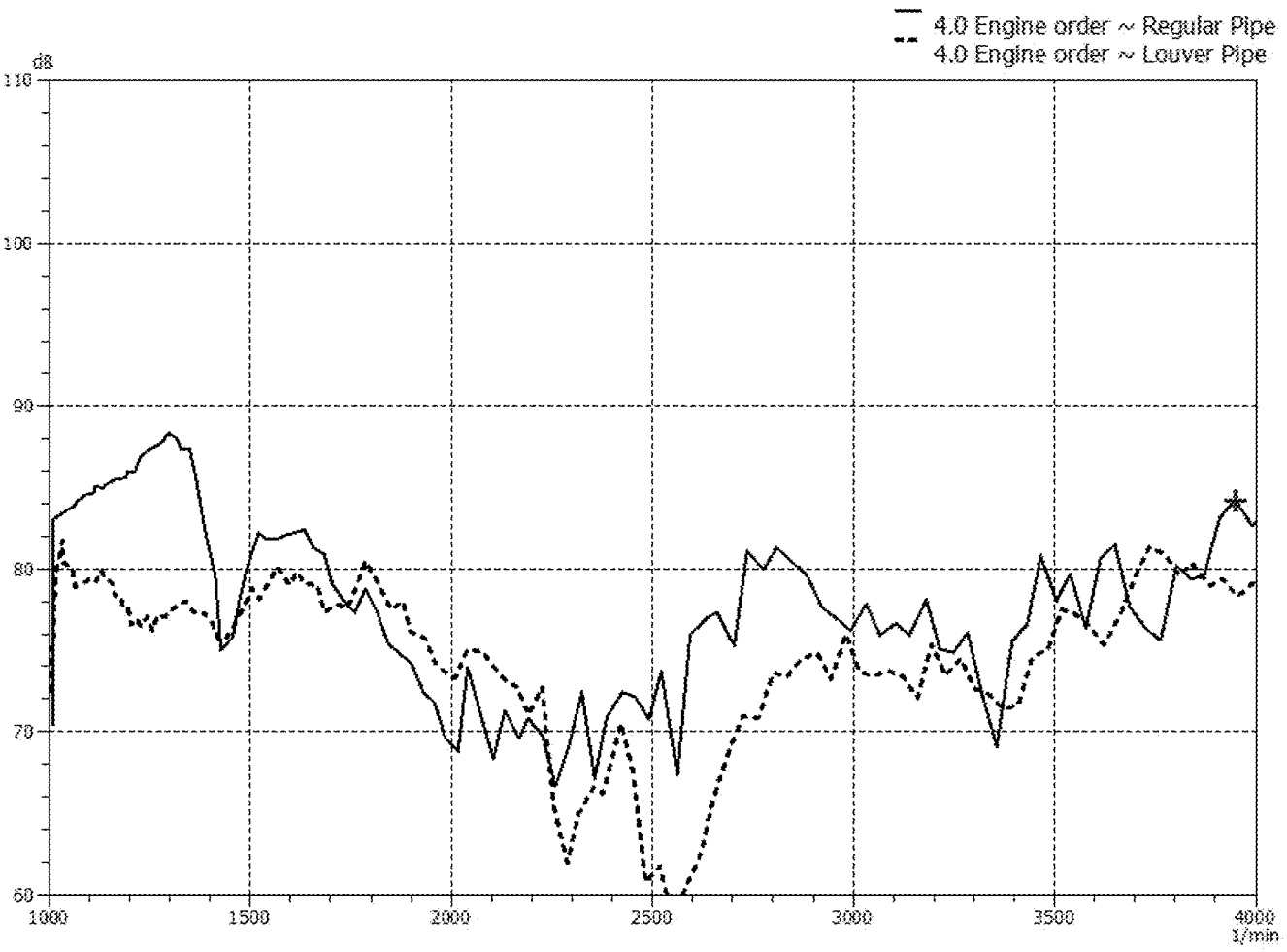
FIG. 14 is a graph showing fourth engine order sound in decibels over a second order frequency of 1000 to 4000 per minute for a regular pipe (solid line) and for the pipe according to the second example of the system according to the invention (dashed line)

FIG. 9 shows measured insertion loss, in solid line, for the exhaust system component 10 as shown and described. A 100 mm length exhaust system component 10 was measured with a microphone disposed at an upstream end of the 100 mm length exhaust system component 10 and a microphone disposed at a downstream end of the 100 mm length exhaust system component 10. FIG. 9 also shows the measured insertion loss, in dashed line, for a same length component of a same diameter having eight 5.0 mm perforations. This 5.0 mm perforation component was measured with a microphone disposed at an upstream side of the 100 mm length and a microphone disposed at a downstream side of the 100 mm length. Insertion loss is shown in decibels over a frequency range of zero to 500 Hz. As can be seen in FIG. 9, particularly in the lower frequency ranges the insertion loss is much greater with the exhaust system component 10 according to the invention. Further, in the higher frequency ranges, there is a frequency shift between the example with perforations and the louver bridge pipe (the exhaust system portion 1 with the exhaust system component 10) because of slightly different pipe length. The lower frequency range is shown in an enlarged graph in FIG. 10 with insertion loss shown in decibels over a frequency range of zero to 100 Hz. This highlights the particularly higher insertion loss that occurs in the lower frequency ranges, for example between zero and 50 Hz, with the exhaust system component 10 of the invention. The higher insertion loss at the lower frequencies is particularly advantageous.

Besides providing a higher insertion loss for the exhaust system portion 1 with the exhaust system component 10 according to a preferred embodiment as compared to a pipe section component having the eight 5.0 mm perforations (FIGS. 9 and 10), particularly in the lower frequency ranges, the system 1 with the exhaust system component 10 according to the invention provides a lowering of second order engine sounds and forth order engine sounds as shown in FIGS. 11, 12, 13 and 14. The graphs of FIGS. 11, 12, 13 and 14 show a 2nd and 4th order Sound-Pressure Level (SPL), in dashed line, of two examples of the louver pipe, namely with the exhaust system portion 1 with the exhaust system component 10. The examples differ based on different exhaust treatment components (a different muffler is used in the first example—FIGS. 11, 12 as compared to the second example—FIGS. 13, 14). The graphs of FIGS. 11, 12, 13 and 14 provide a comparison in solid line based on a regular pipe section component having 5.0 mm perforations (again a different muffler is used in the first example—FIGS. 11, 12 as compared to the second example—FIGS. 13, 14). The SPL is a measure of the sound pressures with units in dB. The exhaust system portion 1 with the exhaust system component 10 according to a preferred embodiment as compared to a pipe section component having 5.0 mm perforations has advantageous SPL in particular frequency ranges for both examples. At higher frequency, the SPL increases somewhat for the exhaust system portion 1 with the exhaust system component 10 according to a preferred embodiment as compared to a pipe section component having 5.0 mm perforations.

Beside significantly attenuating resonant frequencies, the exhaust system component 10 and the exhaust system and exhaust system portion 1 with the exhaust system component 10 according to the invention provides further significant advantages. The configuration is particularly advantageous as the configuration does not create packaging issues as the exhaust system component 10 can be put anywhere along the exterior of the exhaust pipe system 1. The louver bridges 18 can be put on any exhaust gas component, anywhere along a length of the exhaust flow path of the exhaust system 1 that is not prohibited by emissions requirements. For example, the louver bridge portions 18 may placed on any portion of exhaust system 1, including pipe section components 6 upstream of the exhaust treatment component 3 (e.g., upstream of muffler 3) or anywhere along exhaust pipe portion 2, such as on any of the pipe section components 6.

The louver bridges 18 are particularly advantageous as louver bridges 18 act to produce a divergence of flow 40 that is parallel to the exhaust gas flow 60 while dampening pressure pulses within the pipe 12. The flow 40 is parallel to the direction of the pipe 12 itself. The flow 40 does not cause radial impingement of hot exhaust gas. This is illustrated in FIG. 8, which shows the louver bridges 18 directing hot exhaust gas to flow through the openings 30 of one of the louver bridges 18. In particular, the raised portions 19, raised relative to central portion 15 of pipe 12, provides flow openings 30 (in a plane perpendicular to the exhaust gas main flow 60) which provide a divergent flow 40 of the exhaust gas to ambient, which divergent flow 40 is parallel to the exhaust gas main flow 60.

The divergent flow 40 of the louver bridges 18 provides resonance attenuation and damping to reduce noise without causing an error state as to higher frequencies. In particular, pipe section components having perforations, such as the pipe section component having 5.0 mm perforations discussed above, may produce whistle noises at higher frequencies. The louver bridges 18 prevents such whistle noises due to the geometry of the openings 30 with the produced divergent flow 40 of the openings 30. This configuration mitigates any edge effects that are present at the edges 20 and 22 of the openings 30 and which may cause whistling.

The louver bridges 18 are compact and manufacturing friendly. A metal sheet is rolled or otherwise shaped and edges are laser welded to form a tubular pipe. The louver bridges 18 are manufactured by shearing the formed pipe section central portion 15 of pipe 12 to detach bridge raised portion 19, with the side edges 22, from the adjacent opening side edges 20 of the pipe wall 12. This extruding (bending) of the bridge raised portion 19 is such that the inner surface 31 of the raised portion 19 is spaced from the adjacent surface regions 28 of the outer surface 24 of the pipe wall 12. This forms the two openings 30 and the open region 32. Collectively, all louver bridges 18 can be formed in one three step process.

The configuration of the component 10 with louver bridges 18 provides the advantageous resonant frequency attenuation while presenting less overall structure. The exhaust system component 10 is made from sheet-metal, such as sheet steel and otherwise does not include any structural features apart from those discussed above. This is significant as the exhaust component 10 with louver bridges 18 has less overall content compared to a bottle resonator. The louver bridges 18 have a lower mass as compared to a conventional bottle resonator.

The louver bridges 18 also attenuate frequencies so as to lower 1st and 2nd firing orders of a typical exhaust systems' SPL response, as discussed above.

The configuration of the exhaust system component 10 with louver bridges 18 is particularly advantageous with regard to overall assembly of an exhaust system. The louver bridges 18 do not require extra welding processes compared to other resonances damping concepts.

The louver bridges 18 require only a small axial extent along the length of pipe. This is particularly the case with the aligned row of circumferentially distributed louver bridge portions 18 of the disclosed embodiment. However, even with axially distributed louver bridge portions 18, the overall length of the exhaust system component 10 is rather short as compared to prior art arrangements with features to dampen resonance frequencies.

While specific embodiments of the invention have been shown and described in detail to illustrate the application of the principles of the invention, it will be understood that the invention may be embodied otherwise without departing from such principles.

What is claimed is:

1. An exhaust system component comprising:

a pipe extending in a pipe direction and having a pipe wall with an inner surface defining an exhaust gas passage for an exhaust gas flow flowing in the pipe direction and with an outer surface defining an exterior of the component, wherein the wall provides a separation of the exhaust passage from an exterior environment of the component; and a louver bridge portion formed in the pipe wall, the louver bridge portion having bridge ends circumferentially spaced from each other and transitioning from adjacent pipe wall portions to a bridge raised portion with a raised upstream side edge detached from an adjacent upstream opening side edge of the pipe wall and a raised downstream side edge detached from an adjacent downstream opening side edge of the pipe wall, wherein;

the upstream bridge side edge is radially outward of the adjacent upstream opening side edge of the pipe wall to define an upstream louver opening providing fluid communication and fluid passage, through the upstream louver opening, between the exhaust gas passage and the exterior environment of the component; and the downstream bridge side edge is radially outward of the adjacent downstream opening side edge of the pipe wall to define a downstream louver opening providing fluid communication and fluid passage, through the downstream louver opening, between the exhaust gas passage and the exterior environment of the component, the upstream louver opening and the downstream louver opening being provided at each of two opposite sides of the louver bridge portion, whereby fluid communication through the two louver openings, and fluid passage between the exhaust gas passage and the exterior environment of the component, attenuates resonant frequencies generated during operation of an exhaust system to which the exhaust system component is connected.

2. An exhaust system component according to claim 1, wherein the bridge raised portion radially outwardly covers an open region partially defined by the opening side edges at the inner surface of the louver bridge portion and the open region defines a flow path from the exhaust gas passage to each louver opening at the two opposite sides of the louver bridge portion.

3. An exhaust system component according to claim 2, wherein the louver opening at each of two opposite sides of the louver bridge portion forms a portion of the flow path and directs a portion of gas flowing in the pipe out of the pipe through the respective louver opening to produce a gas divergence of flow that is parallel to the exhaust gas flow within the pipe and which does not cause radial impingement of hot exhaust gas.

4. An exhaust system component according to claim 2, wherein:

each of the upstream louver opening and the downstream louver opening has a height corresponding to a radial distance of an associated bridge side edge from the adjacent opening side edge of the pipe wall and has a length from one bridge end to another bridge end wherein the length of the louver opening is greater than the height of the louver opening; and the bridge raised portion extends essentially along a bridge arc corresponding to a bridge diameter circle and the adjacent pipe wall portions extend mostly along an arc having a diameter smaller than a diameter of the bridge diameter circle.

5. An exhaust system component according to claim 2, further comprising at least an additional louver bridge portion that is essentially the same as said louver bridge portion to provide a plurality of louver bridge portions.

6. An exhaust system component according to claim 5, wherein the plurality of louver bridge portions are disposed circumferentially spaced from each other.

7. An exhaust system component according to claim 5, wherein the plurality of louver bridge portions are disposed longitudinally spaced from each other.

8. An exhaust system component according to claim 5, wherein the plurality of louver bridge portions are disposed in multiple rows of bridge portions.

9. An exhaust system component according to claim 5, wherein the plurality of louver bridge portions are disposed in staggered rows of bridge portions.

10. An exhaust system component according to claim 2, wherein the pipe wall and the louver bridge is formed of a single sheet metal piece.

11. An exhaust system comprising:

an exhaust treatment component; and an exhaust pipe connected to the exhaust treatment component, the exhaust pipe comprising an exhaust system component, the exhaust system component comprising:

a pipe extending in a pipe direction and having a pipe wall with an inner surface defining an exhaust gas passage for an exhaust gas flow flowing in the pipe direction and with an outer surface defining an exterior of the component, wherein the wall provides a separation of the exhaust passage from an exterior environment of the component; and a louver bridge portion formed in the pipe wall, the louver bridge portion having bridge ends circumferentially spaced from each other and transitioning from adjacent pipe wall portions to a bridge raised portion with a raised upstream side edge detached from an adjacent upstream opening side edges of the pipe wall and a raised downstream side edge detached from an adjacent downstream opening side edge of the pipe wall, wherein;

the upstream bridge side edge is radially outward of the adjacent upstream opening side edge of the pipe wall to define an upstream louver opening providing fluid communication and fluid passage, through the upstream louver opening, between the exhaust gas passage and the exterior environment of the component; and the downstream bridge side edge is radially outward of the adjacent downstream opening side edge of the pipe wall to define a downstream louver opening providing fluid communication and fluid passage, through the downstream louver opening, between the exhaust gas passage and the exterior environment of the component, the upstream louver opening and the downstream louver opening being provided at each of two opposite sides of the louver bridge portion, whereby fluid communication through the two louver openings, and fluid passage between the exhaust gas passage and the exterior environment of the component, attenuates resonant frequencies generated during operation of the exhaust system.

12. An exhaust system according to claim 11, wherein the bridge raised portion radially outwardly covers an open region partially defined by the opening side edges at the inner surface of the louver bridge portion and the open region defines a flow path from the exhaust gas passage to each louver opening at the two opposite sides of the louver bridge portion.

13. An exhaust system according to claim 12, wherein the louver opening at each of two opposite sides of the louver bridge portion forms a portion of the flow path and directs a portion of gas flowing in the pipe out of the pipe through the respective louver opening to produce a gas divergence of flow that is parallel to the exhaust gas flow within the pipe and which does not cause radial impingement of hot exhaust gas.

14. An exhaust system according to claim 12, wherein:

each of the upstream louver opening and the downstream louver opening has a height corresponding to a radial distance of an associated bridge side edge from the adjacent opening side edge of the pipe wall and has a length from one bridge end to another bridge end wherein the length of the louver opening is greater than the height of the louver opening; and the bridge raised portion extends essentially along a bridge arc corresponding to a bridge diameter circle and the adjacent pipe wall portions extend mostly along an arc having a diameter smaller than a diameter of the bridge diameter circle.

15. An exhaust system according to claim 12, further comprising at least an additional louver bridge portion that is essentially the same as said louver bridge portion to provide a plurality of louver bridge portions.

16. An exhaust system according to claim 15, wherein the plurality of louver bridge portions are disposed circumferentially spaced from each other.

17. An exhaust system according to claim 15, wherein the plurality of louver bridge portions are disposed longitudinally spaced from each other.

18. An exhaust system according to claim 15, wherein the plurality of louver bridge portions are disposed in multiple rows of bridge portions.

19. An exhaust system according to claim 15, wherein the plurality of louver bridge portions are disposed in staggered rows of bridge portions.

20. An exhaust system according to claim 12, wherein the pipe wall and the louver bridge is formed of a single sheet metal piece.

* * * * *